US007934436B2

(12) United States Patent
Laubender

(10) Patent No.: US 7,934,436 B2
(45) Date of Patent: May 3, 2011

(54) STARTER DEVICE FOR STARTING INTERNAL COMBUSTION ENGINES

(75) Inventor: Jochen Laubender, Markgröningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/089,242

(22) PCT Filed: Oct. 6, 2006

(86) PCT No.: PCT/EP2006/067131

§ 371 (c)(1),
(2), (4) Date: Jun. 25, 2008

(87) PCT Pub. No.: WO2007/039642

PCT Pub. Date: Apr. 12, 2007

(65) Prior Publication Data

US 2009/0133532 A1 May 28, 2009

(30) Foreign Application Priority Data

Oct. 6, 2005 (DE) ..... 10 2005 048 599

(51) Int. Cl.
*F02N 15/06* (2006.01)

(52) U.S. Cl. ..... 74/7 R

(58) Field of Classification Search ..... 74/6, 7 A, 74/7 R, 7 C, 7 E; 290/36 R, 38 R; 123/179.25, 123/179.3; 310/15, 17, 19, 20, 21, 23, 28, 310/29

See application file for complete search history.

(56) References Cited

U.S. PATENT DOCUMENTS

| | | | | |
|---|---|---|---|---|
| 2,863,320 | A | 12/1958 | Mendenhall | |
| 6,109,122 | A * | 8/2000 | Bori et al. | 74/7 E |
| 6,975,191 | B2 * | 12/2005 | Ward | 335/18 |
| 2001/0047785 | A1 * | 12/2001 | Osada et al. | 123/179.3 |

FOREIGN PATENT DOCUMENTS

| | | |
|---|---|---|
| DE | 199 11 161 | 9/2000 |
| DE | 100 05 005 | 10/2000 |
| DE | 10 2005 004 326 | 2/2006 |
| DE | 10 2004 041 618 | 3/2006 |
| GB | 566 399 | 12/1944 |
| JP | 58-77166 | 5/1983 |
| JP | 2002089422 A * | 3/2002 |
| JP | 2002221133 | 8/2002 |
| WO | 02/35088 | 5/2002 |
| WO | 03/081623 | 10/2003 |

* cited by examiner

*Primary Examiner* — Thomas R Hannon
*Assistant Examiner* — Phillip A Johnson
(74) *Attorney, Agent, or Firm* — Michael J. Striker

(57) ABSTRACT

The invention relates to a starter device (1) for starting internal combustion engines, comprising an electromagnetic toe-in mechanism which is used to displace an axially displaceable pinion shaft (5), starter pinions (6) which are arranged in the front thereof, in addition to a start-stop mechanism which is embodied in such a manner that in a stop phase of the internal combustion engine, even when the internal combustion engine is stopped, said start-stop mechanism provokes a positioned state of the toe-in mechanism, such that during a subsequent starting of the internal combustion engine, the starter pinion (6) is already arranged in an advanced position, enabling power loss to be reduced. This is achieved by a maintaining mechanism (15) which maintains the electromagnetic toe-in mechanism in the advanced position and in a currentless manner during and/or after the stop phase.

17 Claims, 4 Drawing Sheets

STARTER DEVICE FOR STARTING INTERNAL COMBUSTION ENGINES

BACKGROUND OF THE INVENTION

The invention relates to a starter device for starting internal combustion engines.

PRIOR ART

DE 199 11 161 C2 has disclosed and described a starter device for starting internal combustion engines, which is embodied in the form of a coaxial starter. It includes an electric starter motor and a pre-engagement mechanism for moving an axial pinion shaft equipped with a starter pinion situated at its front end. In order to start the internal combustion engine, the pinion must engage with a ring gear of the engine. When the engine is running, the pinion must be pulled back out of the ring gear. In order to make this possible, the pre-engagement mechanism is provided with a permanent magnet and an electromagnetically excitable coil. A bridge circuit of an electrical control unit of the pre-engagement mechanism permits there to be two flow directions in the coil. Depending on the flow direction, the permanent magnet exerts a pushing force or a pulling force. This makes it possible to extend or retract the pinion.

There are also known starter devices of the generic type that permit a so-called start/stop operation. This is distinguished by the fact that an immediate starting of the internal combustion engine is possible. When the engine is switched off, the pinion is already situated in the ring gear so that all that is required is a rotating motion of the pinion. A prerequisite for this is that in a stop phase of the engine, the pinion is already engaged or extended during the switching off of the engine and remains engaged for the duration of the stop phase.

A start/stop operation of the type mentioned above offers the advantage of a reduced starting time and also permits a more gentle, reduced-noise starting of the internal combustion engine.

Known designs, however, require an additional electrical output, which places an additional load on the electrical system and results in a power loss even while the vehicle is not running.

SUMMARY OF THE INVENTION

The starter device according to the invention reduces the power loss in that a holding mechanism simply holds the pre-engagement mechanism in the extended position without current.

The present invention uses the advantages of a start/stop operation, but without having to accept the disadvantage of an additional consumption of current.

The present invention permits a reduced-noise starting of the internal combustion engine and increases starting convenience while consuming a small amount of electrical energy. It also prevents excessive heating of circuits and components contained therein such as coils, solenoid switches, relays, resistors, and the like. The load on the electrical system and lines is also reduced.

Preferably, the start/stop mechanism is embodied so that it travels into an engaged position during a switching off of the engine. This permits a restarting within a time span of less than one second.

In an advantageous modification of the starter device according to the invention, the holding mechanism holds the electromagnetic pre-engagement mechanism in the engaged position without current during and after the stop phase. As a result, a rotating motion of a ring gear of the internal combustion engine is used so that the pinion of the starter device can easily engage in the ring gear. After the stop phase, no electrical energy is required.

A preferred, particularly simple design is characterized in that the holding mechanism includes two permanent magnets that are arranged so that a magnetic holding force is exerted in the engaged position, which holds the starter pinion in the extended position. The permanent magnets can exert a powerful holding force and are very suitable for this purpose.

If a first, movable permanent magnet situated within the effective range of a magnetic coil of the electromagnetic pre-engagement mechanism is provided, which exerts the holding force together with an opposite-polarity second permanent magnet, with the first permanent magnet being situated within the effective range of the second permanent magnet in the engaged state, then this yields a simple construction because the first magnet functions both as the armature and as the holding mechanism and consequently, only one additional magnet is required.

In an advantageous variant of the invention, the holding mechanism is arranged parallel to a drive shaft of the electromotive drive unit and is connected to it via a lever arm. This requires fewer structural changes to the motor drive itself because the holding mechanism is situated outside of it to all intents and purposes.

In an alternative embodiment variant of the invention, the holding mechanism is arranged coaxial to a drive shaft of the electromotive drive unit of the starter device; in particular, a first and second annular magnet of the holding mechanism are arranged coaxially around the drive shaft. This design, by contrast, is very compact. It is thus possible to significantly reduce a longitudinal dimension if the first permanent magnet has a smaller outer diameter than the inner diameter of the second permanent magnet, thus allowing the first permanent magnet to travel into the second permanent magnet.

In order to produce a functionally reliable position change of the pinion, it is useful if a force-exerting spring is provided, whose spring force is oriented in opposition to a holding force, in particular a magnetic holding force, of the pre-engagement mechanism and/or if the pre-engagement mechanism can be moved from the engaged state into the disengaged state by means of a reversed current supply to an armature. In addition, this function becomes even more reliable if a freewheel mechanism with a speed-dependent restoring torque is provided.

BRIEF DESCRIPTION OF THE DRAWINGS

Two exemplary embodiments of the invention will be explained in greater detail below in conjunction with the accompanying drawings.

DETAILED DESCRIPTION OF THE PREFERRED EMBODIMENTS

Figure 1:
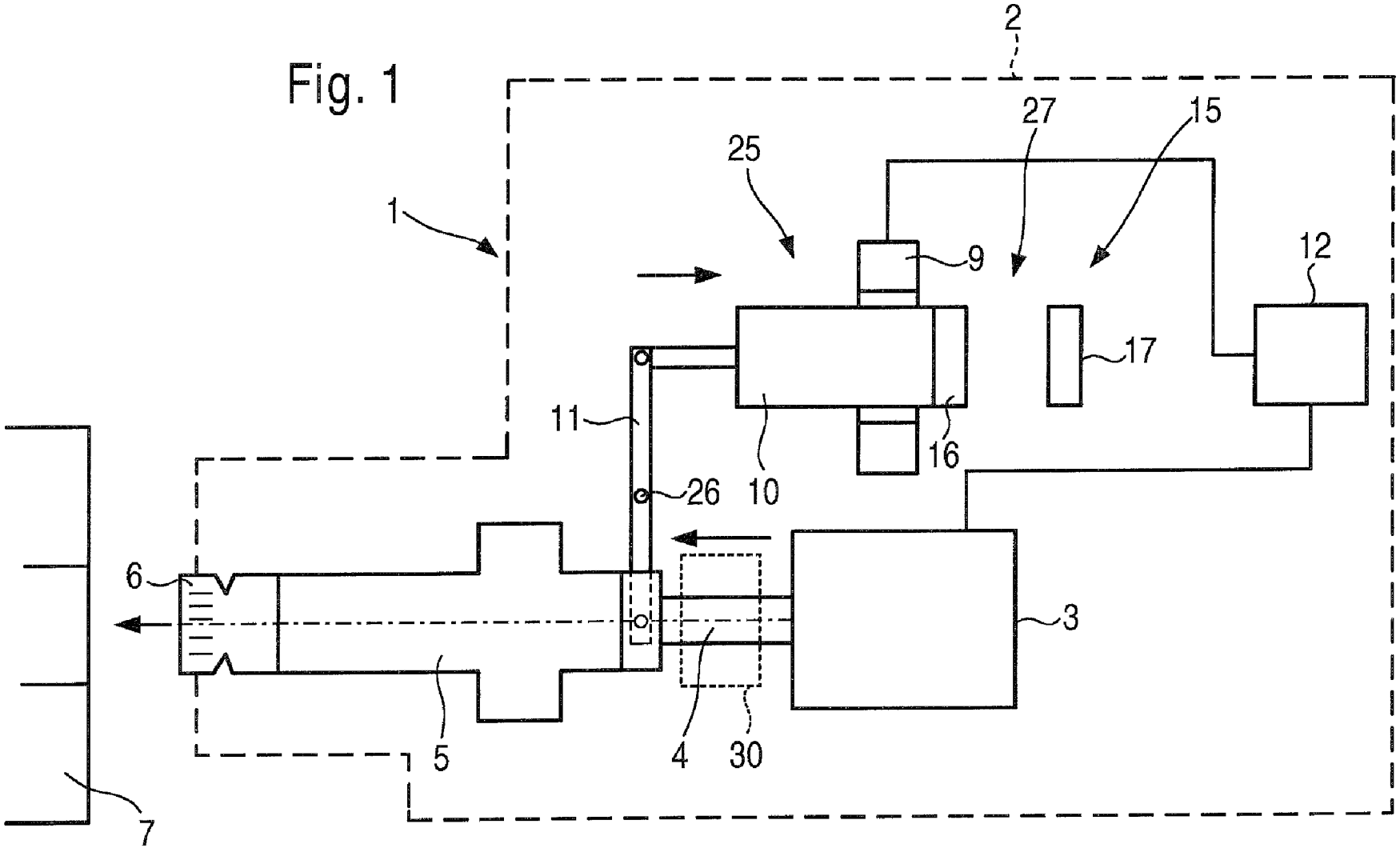
FIG. 1 is a schematic depiction of a first embodiment of a starter device according to the invention.

FIG. 1 is a schematic depiction of a first embodiment of a starter device 1 according the invention. It includes a housing 2 that contains an electromotive drive unit, i.e. a starter motor 3, equipped with a drive shaft 4. Arranged coaxially around the drive shaft 4 is a slidable pinion shaft 5, which is preferably provided at the front with a starter pinion 6 for turning a ring gear 7 of an internal combustion engine.

The starter pinion 6 can be brought into an extended position with the aid of a pre-engagement mechanism so that the starter pinion 6 engages in the ring gear 7 (engaged position) or can be brought into a non-engaged position so that the starter pinion 6 retracts partially or completely into the housing 2.

The pre-engagement mechanism includes an armature 10 with a coil 9 in order to exert a force on the pinion shaft 5 by means of a two-arm lever 11. This force can extend or retract the pinion shaft 5.

A control unit 12 is provided for controlling the coil 9 and the starter motor 3.

According to the invention, a holding mechanism 15 is provided, which will be explained in greater detail in conjunction with FIGS. 2 and 3.

The starter device 1 is distinguished by a start/stop mechanism that is implemented with the aid of the control unit 12 and that is embodied so that in a stop phase of the internal combustion engine, during and/or after a switching off of the engine, this mechanism produces an engaged position (FIG. 3) of the pre-engagement mechanism so that in a subsequent starting of the engine, the starter pinion 6 is already situated in an extended position.

The starter pinion 6 can be brought into the engaged position through a supply of current to the coil 9 during and/or after the switching off of the engine. It remains there until the engine is started again. After the engine is started, the starter pinion 6 is brought into a disengaged position by means of a reversed current supply to the coil 9.

The holding mechanism 15 preferably includes two permanent magnets 16, 17 that are arranged so that in the engaged position (FIG. 3), a magnetic holding force is exerted that holds the starter pinion 6 in the extended position. In the disengaged position, the first permanent magnet 16 is spaced apart from the second permanent magnet 17, as shown in FIG. 2. During the engaging process, the first permanent magnet 16 is moved toward the second, stationary permanent magnet 17 until it comes into contact with it. The holding mechanism 15 therefore holds the electromagnetic pre-engagement mechanism without current in the extended position shown in FIG. 3 during the stop phase.

Figure 2:
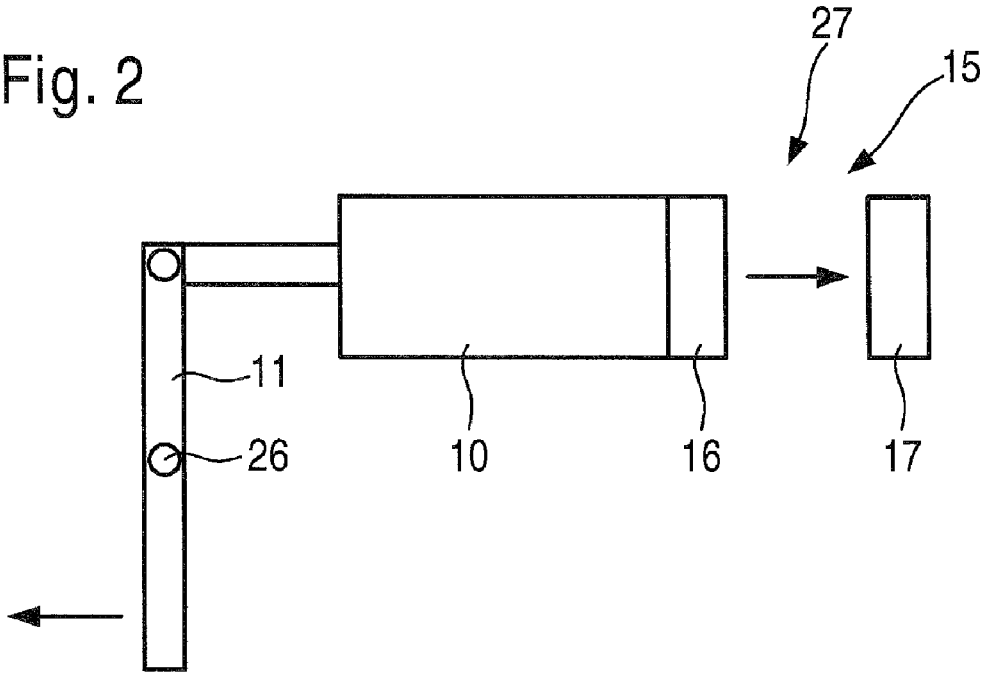
FIG. 2 is a schematic depiction of a holding mechanism according to the embodiment in FIG. 1, shown in a non-engaged position.
Figure 3:
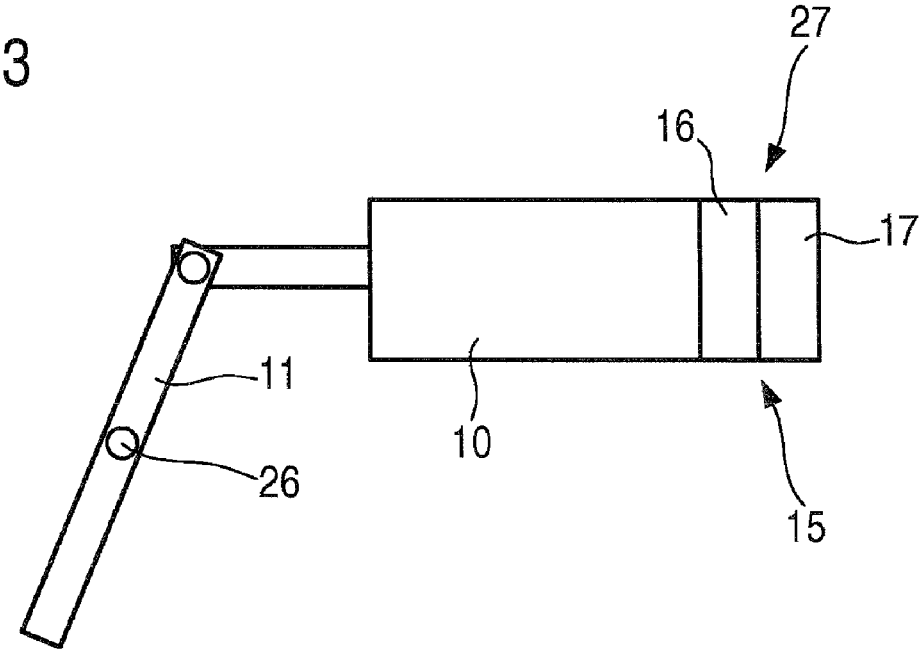
FIG. 3 is a schematic depiction of the holding mechanism from FIG. 2, shown in an engaged position.

In the embodiment shown in FIGS. 1 through 3, the holding mechanism extends parallel to the drive shaft, i.e. the shaft 4 of the electromotive drive unit, and is situated outside the latter. The holding mechanism (FIG. 2, FIG. 3) is connected via the lever 11 to pinion shaft 5. The movement direction of the magnet 16, which constitutes a magnetic armature, extends parallel to the rotation axis, i.e. to the shaft 4 or 5 of the electromotive drive unit.

Figure 4:
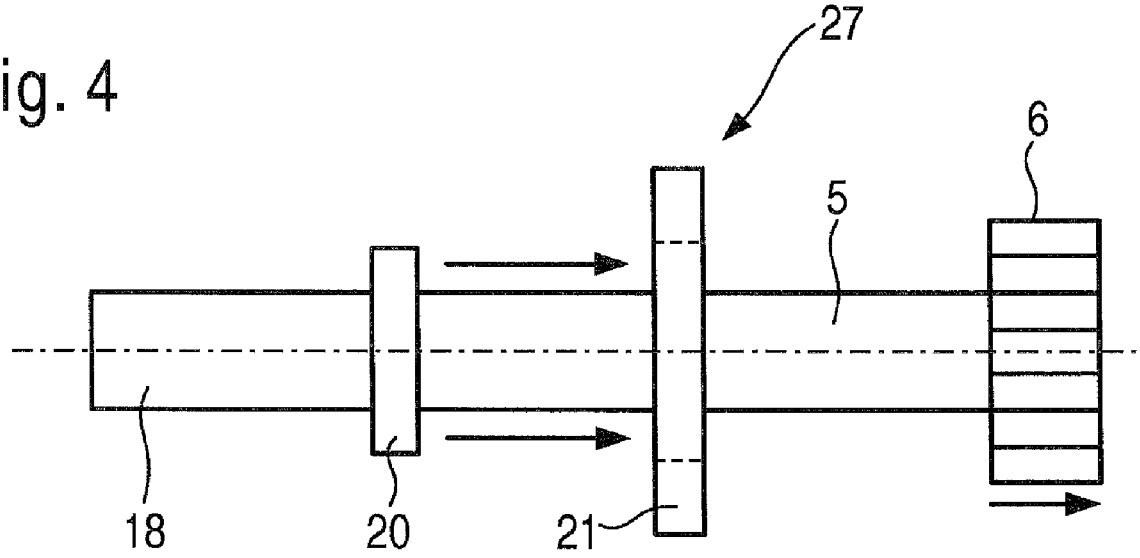
FIG. 4 is a schematic depiction of an alternative embodiment of the holding mechanism, shown in a non-engaged position.
Figure 5:
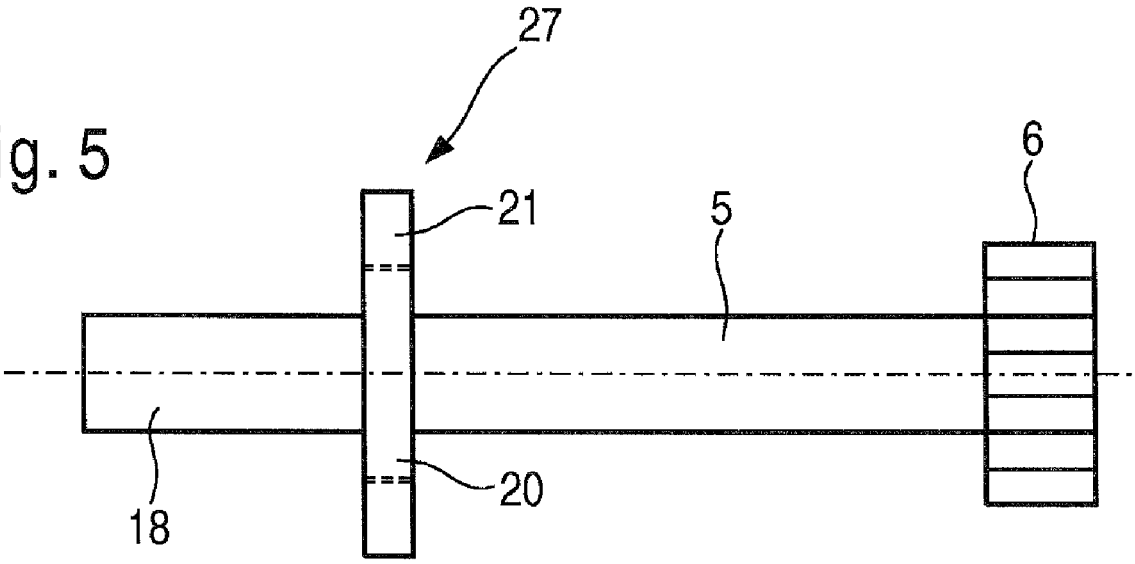
FIG. 5 is a schematic depiction of the holding mechanism from FIG. 4, shown in an engaged position.
Figure 6:
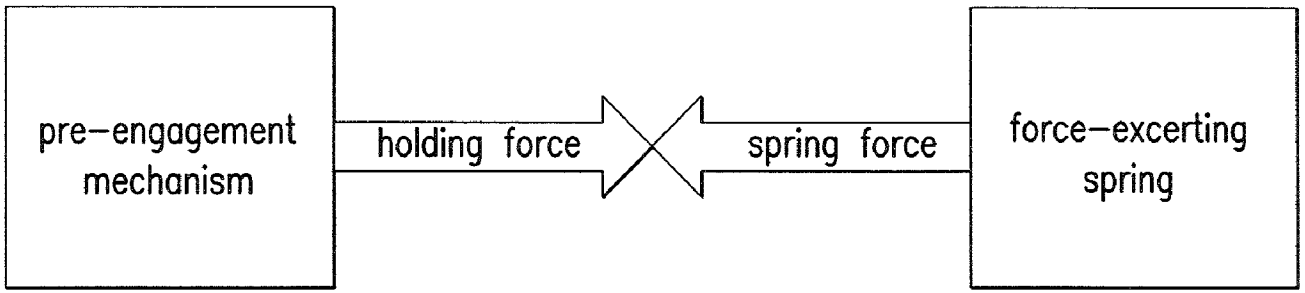
FIG. 6 is a schematic depiction showing that a force-exerting spring is provided, whose spring force is directed against a holding force of the pre-engagement mechanism.
Figure 7:
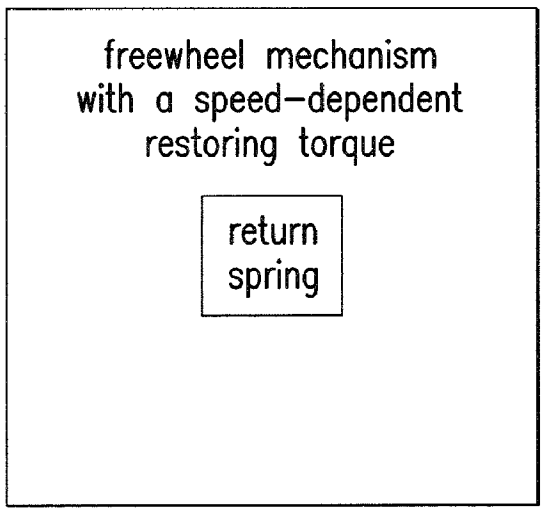
FIG. 7 is a schematic depiction of a freewheel mechanism with a speed-dependent restoring torque and a return spring.
Figure 8:
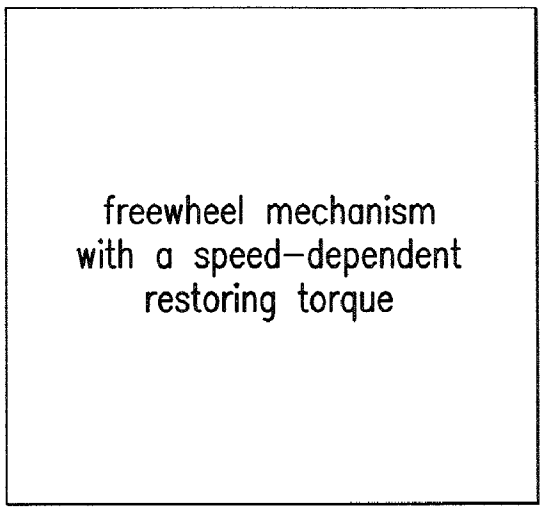
FIG. 8 is a schematic depiction of a freewheel mechanism with a speed-dependent restoring torque.

By contrast, in an alternative embodiment according to FIGS. 4 and 5, the holding mechanism extends coaxial to the drive shaft 18. This is preferably achieved by a first and second annular magnet 20, 21, which are arranged coaxially around the drive shaft 18. The first annular magnet 20 has a smaller outer diameter than the inner diameter of the second annular magnet 21, thus allowing the first annular magnet 20 to travel into the second annular magnet 21, as shown in FIG. 5.

The embodiments described above can include a force-exerting spring, which is not shown in the drawings. Its spring force would be oriented in opposition to the magnetic holding force. Alternatively or in addition, the pre-engagement mechanism could be movable from the engaged state into the disengaged state by means of a reversed current supply to the armature. In addition, a freewheel mechanism with a speed-dependent restoring torque could be provided.

The control unit 12 can also have a first electrical control unit for the electromotive drive unit and a second electrical control unit for the electromagnetic pre-engagement mechanism, the first and second control unit being coupled to each other so that a start/stop operation occurs.

In summary and in addition, the following should be noted:

The magnets 16, 17, 20, 21 in the arrangements (FIGS. 2-5) have opposite polarities (north pole/south pole). The two magnets are built into a solenoid switch of the starter device in opposing positions for all intents and purposes. During the engagement process, as the drive shaft is being moved into position, the two magnets are brought into each other's effective range so that after the corresponding circuit is switched off, a fixing of the shaft for the pre-engagement occurs in a purely magnetic fashion. The disengagement after the turning over and successful starting of the engine then preferably occurs either electrically, i.e. by means of a reversed current supply to the circuit, or also mechanically by means of a prestressed spring that is placed under stress during the engagement process. The magnetic force in the interaction between the two magnets therefore must compensate for and overcome the return force of the stressed spring so that the starter device remains securely fixed in the engaged position during the start/stop operation, even in the event of possible vibrations of the vehicle, e.g. due to bumps in the roadway. The subsequent disengagement occurs, for example, by means of the freewheel mechanism (in a speed-dependent fashion) and at a definite speed threshold, disconnecting the starter device from the internal combustion engine when the overall restoring torque exceeds the magnetic force between the two magnets.

What is claimed is:

1. A starter device (1) for starting internal combustion engines, comprising:

an electromagnetic pre-engagement mechanism having an axially movable pinion shaft (5) with a starter pinion (6), wherein said electromagnetic pre-engagement mechanism is configured for moving said axially movable pinion shaft (5);

a holding mechanism (15) that holds the electromagnetic pre-engagement mechanism in an extended position without current during and/or after a stop phase, wherein the holding mechanism (15) holds the electromagnetic pre-engagement mechanism in an engaged position without current during and after the stop phase, wherein the holding mechanism (15) includes two permanent magnets (16, 17) that are arranged so that a magnetic holding force is exerted in the engaged position, wherein said magnetic holding force holds the starter pinion (6) in an extended position;

wherein said two permanent magnets include a first, movable permanent magnet (16) and a opposite-polarity second permanent magnetic (17), wherein said first, moveable permanent magnet is situated within the effective range of a magnetic coil (9) of the electromagnetic pre-engagement mechanism, wherein said first moveable permanent magnet is configured to exert the holding force together with the opposite-polarity second permanent magnet (17), wherein the first permanent magnet (16) is situated within the effective range of the second permanent magnet (17) in the engaged state; and a magnet armature (10), wherein the first and second permanent magnets (16, 17) and the magnet armature (10) are arranged successively in a row.

2. The starter device as recited in claim 1, wherein the holding mechanism (15) is arranged parallel to a drive shaft (18) of an electromotive drive unit of the starter device (1) and is connected to said drive shaft via a lever arm (11).

3. The starter device as recited in claim 1, wherein the holding mechanism (15) is arranged coaxial to a drive shaft (18) of an electromotive drive unit of the starter device (1).

4. The starter device as recited in claim 1, wherein the first permanent magnet (20) has a smaller outer diameter than the inner diameter of the second permanent magnet (21), thus allowing the first permanent magnet (20) to travel into the second permanent magnet (21).

5. The starter device as recited in claim 1, further comprising wherein a force-exerting spring having a spring force oriented in opposition to a holding force of the pre-engagement mechanism.

6. The starter device as recited in claim 1, wherein the pre-engagement mechanism is configured to move from the engaged state into a disengaged state by means of a reversed current supply to a coil.

7. The starter device as recited in claim 1, further comprising a freewheel mechanism with a speed-dependent restoring torque.

8. The starter device as recited in claim 7, further comprising a freewheel mechanism with a return spring.

9. The starter device as recited in claim 1, wherein a movement direction of a magnet armature (10) and a first annular magnet (20) of the pre-engagement mechanism connected to the magnet armature (10) extend parallel to a rotation axis of an electromotive drive unit of the starter device (1).

10. The starter device as recited in claim 1, wherein a first (20) and second annular magnet (21) of the holding mechanism (15) are arranged coaxially around the drive shaft (18).

11. The starter device as recited in claim 1, wherein a movement direction of a magnet armature (10) and the first annular magnet (20) of the pre-engagement mechanism connected to the magnet armature (10) extend parallel to a rotation axis of the electromotive drive unit.

12. The starter device as recited in claim 1, wherein a first (20) and second annular magnet (21) of the holding mechanism (15) are arranged coaxially around the drive shaft (18).

13. A starter device (1) for starting internal combustion engines, comprising:

an electromagnetic pre-engagement mechanism having an axially movable pinion shaft (5) with a starter pinion (6), wherein said electromagnetic pre-engagement mechanism is configured for moving said axially movable pinion shaft (5);

a holding mechanism (15) that holds the electromagnetic pre-engagement mechanism in an extended position without current during and/or after a stop phase, wherein the holding mechanism (15) holds the electromagnetic pre-engagement mechanism in the engaged position without current during and after the stop phase, wherein the holding mechanism (15) includes two permanent magnets (16, 17) that are arranged so that a magnetic holding force is exerted in the engaged position, wherein said magnetic holding force holds the starter pinion (6) in an extended position, wherein said two permanent magnets (16, 17) include a first, movable permanent magnet (16) and a second opposite-polarity permanent magnetic, wherein said first moveable permanent magnet is situated within the effective range of a magnetic coil (9) of the electromagnetic pre-engagement mechanism, wherein said permanent magnet is configured to exert the holding force together with said opposite-polarity second permanent magnet (17), wherein the first permanent magnet (16) is situated within the effective range of the second permanent magnet (17) in the engaged state, wherein the holding mechanism (15) is arranged coaxial to a drive shaft (18) of an electromotive drive unit of the starter device (1), and wherein the first permanent magnet (20) has a smaller outer diameter than the inner diameter of the second permanent magnet (21), thus allowing the first permanent magnet (20) to travel into the second permanent magnet (21).

14. The starter device as recited in claim 13, further comprising a force-exerting spring having a spring force oriented in opposition to a holding force of the pre-engagement mechanism.

15. The starter device as recited in claim 13, wherein the pre-engagement mechanism is configured to move from the engaged state into a disengaged state by means of a reversed current supply to a coil.

16. The starter device as recited in claim 13, further comprising a freewheel mechanism with a speed-dependent restoring torque.

17. The starter device as recited in claim 13, further comprising a freewheel mechanism with a return spring.

* * * * *